US005172864A

United States Patent [19]

Spencer

[11] Patent Number: 5,172,864

[45] Date of Patent: Dec. 22, 1992

[54] ROTARY SPRINKLER

[75] Inventor: Benjamin Spencer, Zichron Yaacob, Israel

[73] Assignee: Dan Mamtirim, Galil Elyon, Israel

[21] Appl. No.: 724,159

[22] Filed: Jul. 1, 1991

[30] Foreign Application Priority Data

Jul. 12, 1990 [IL] Israel ..... 95056

[51] Int. Cl.[5] ..... B05B 3/04

[52] U.S. Cl. ..... 239/241; 239/230; 239/601

[58] Field of Search ..... 239/241, 230, 237, 263, 239/240, 589, 601

[56] References Cited

U.S. PATENT DOCUMENTS

| | | | |
|---|---|---|---|
| 2,009,478 | 7/1935 | Coles et al. | 239/241 |
| 2,052,673 | 9/1936 | Stanton | 239/241 |
| 3,127,110 | 3/1964 | Reynolds | 239/230 |
| 3,602,431 | 8/1971 | Lockwood | 239/230 |
| 3,627,205 | 12/1971 | Healy | 239/230 |
| 3,715,078 | 2/1973 | Reynolds | 239/241 |
| 3,924,809 | 12/1975 | Troup | 239/230 |
| 4,364,519 | 12/1982 | Kreitzberg | 239/601 |
| 4,493,458 | 1/1985 | Bron | 239/230 |
| 4,619,402 | 10/1986 | Yamamoto | 239/601 |
| 4,796,810 | 1/1989 | Zakai | 239/601 |

*Primary Examiner*—Andres Kashnikow
*Assistant Examiner*—Christopher G. Trainor
*Attorney, Agent, or Firm*—Ladas & Parry

[57] ABSTRACT

A rotary sprinkler of the kind wherein an outlet nozzle having an integrally formed impeller element is adapted to be driven by a drive ball located within a drive ball enclosure wherein a first major axial portion of the side wall extends from the base wall of the enclosure to an intermediate peripheral position thereof and defines a first angle $\alpha_1$ with respect to a normal to the base wall while a second minor axial portion of the side wall extends from the intermediate peripheral position to an edge rim of the enclosure and defines a second angle $\alpha_2$ with respect to a normal to the base wall, $\alpha_2$ being substantially greater than $\alpha_1$, the impact element being spaced from the intermediate peripheral position by a distance which is not substantially less than one half the diameter of the drive ball.

3 Claims, 3 Drawing Sheets

ROTARY SPRINKLER

FIELD OF THE INVENTION

This invention relates to a rotary sprinkler, and in particular to a rotary sprinkler of the kind having a rotatably mounted outlet nozzle arranged to be rotated by a water driven ball-impact type motor.

BACKGROUND OF THE INVENTION

Rotary sprinklers having water driven ball-impact type drive motors have long been known. With such sprinklers, a drive ball is located within a drive motor enclosure, itself fixedly located within a sprinkler housing, and upon the inflow of water through tangentially directed openings formed in the motor enclosure, the drive ball is rotatably displaced within the housing and, during its rotational displacement, successively impacts an impeller element formed integrally with the rotatable outlet nozzle, thereby causing rotation of the nozzle. An example of a rotary sprinkler having such a ball-impact type drive motor is disclosed, for example, in U.S. Pat. No. 2,052,673 (Stanton). In this known type of rotary sprinkler, the motor enclosure has a relatively limited axial dimension and the rotary displacement of the drive ball is within a uniquely defined ball race into which the impeller element projects. In consequence, the successive impacting of the impeller element by the ball takes place at very short intervals (each interval corresponding to the time taken for the ball to perform a complete rotational movement within the ball race). In effect, therefore, and despite the fact that the impact element is intermittently struck by the ball, the intervals between successive impacts is so small that the impact element, and in consequence the nozzle, is substantially continuously rotated.

It is known that the range of spray of such rotary sprinklers wherein the outlet nozzle is substantially continuously rotated, tends to be very limited. It is therefore known to provide rotary sprinklers with an intermittent drive wherein a relatively significant time elapses between successive rotational displacements of the nozzle. One well-known form of rotary sprinkler wherein such spaced-apart intermittent displacements of the nozzle is achieved, is the impact hammer-type rotary sprinkler. A disadvantage of such impact hammer-type sprinklers resides in the fact that they are of a relatively complicated construction and are, on the one hand, relatively expensive and, on the other hand, involving as they do a significant number of moving parts, faulty operation of the sprinkler is likely requiring periodic maintenance and servicing.

In order to achieve the desired spaced-apart intermittent displacements of the rotary sprinkler using a ball-impact type drive motor, it is necessary to ensure that the time interval between successive impacting of the impeller element of the nozzle by the ball is substantially increased. One known way of achieving such an increase in this time interval is by extending the axial extent of the motor enclosure and providing the enclosure, in addition to its base wall (in which are located one or more tangentially directed water inlets), with an outwardly tapering side wall, the impeller element being located adjacent the flared mouth of the enclosure. With a rotary sprinkler having such a drive motor (shown, for example, in U.S. Pat. Nos. RE 25942 and 2,990,120 (Reynolds), once the drive ball is set into rotational displacement under the influence of the tangentially directed water inflow, the ball effectively climbs the outwardly tapering wall of the enclosure in an upwardly directed rotary manner, and only when the ball has reached the upper end of the enclosure does it strike the impeller element rotating the latter and thereby imparting an instantaneous rotation to the nozzle. After striking the impeller element, the momentum of the ball is lost and the ball moves gravitationally downwards, only to be struck again by the tangentially directed water inflow and to repeat its rotational upward movement until it again strikes the impeller element. In this way, it is ensured that the successive impacting of the impeller element by the ball is significantly spaced apart in time.

With such known rotary sprinklers, however, the first impacting contact between the drive ball and the impeller element takes place when the upper tip of the drive ball contacts the impeller element. In view of the fact that contact between the drive ball and the impeller element is limited to the tip of the drive ball, there is not really an effective transfer of momentum of the drive ball to the impeller element, and the rotary displacement of the impeller element, and in consequence the rotary nozzle, may well prove to be inadequate.

BRIEF SUMMARY OF THE INVENTION

It is an object of the present invention to provide a rotary sprinkler with a ball-impact drive motor in which the above-referred-to disadvantage is substantially overcome.

According to the present invention there is provided a rotary sprinkler comprising a sprinkler housing; a water inlet of said housing; an outlet nozzle of said housing rotatably mounted with respect thereto; an open ended drive motor enclosure fixedly located within said housing; a base wall of said enclosure; an axially directed side wall of said enclosure which tapers outwardly with respect to said base wall; at least one tangentially directed opening formed in said base wall and communicating with said water inlet; a drive ball of predetermined diameter (D) located in said enclosure; an impact element formed integrally with said nozzle and spaced from said base wall by a distance which is not substantially less than 2 D;

characterised in that a first major axial portion of said side wall extending from said base wall to an intermediate peripheral position thereof defines a first angle $\alpha_1$ with respect to a normal to the said base wall whilst a second minor axial portion of said side wall, extending from said intermediate peripheral position to an edge rim of the enclosure, defines a second angle $\alpha_2$ with respect to a normal to the base wall wherein $\alpha_2$ is substantially greater than $\alpha_1$, said impact element being spaced from said intermediate peripheral position by a distance which is not substantially less than 0.5 D.

With such a sprinkler, once the rotating drive ball has been upwardly displaced until it reaches the intermediate peripheral position, the continued rotational displacement of the ball is accompanied by a relatively substantial upward displacement as the ball climbs the minor axial portion of the side wall, so that impact between the drive ball and the impeller element will take place at an intermediate position on the drive ball, thereby ensuring the effective transmission of momentum from the drive ball to the impeller element.

In accordance with another aspect of the present invention, there is provided a rotary sprinkler comprising a sprinkler housing, a water inlet of said housing, and an outlet nozzle of said housing rotatably mounted with respect thereto having defined therein an axially directed tubular throughflow passage and an outlet passage of the nozzle communicating with the throughflow passage and formed with a curved, deflecting wall, characterised in that the throughflow passage communicates with the outlet chamber by a substantially elliptically shaped orifice.

BRIEF SUMMARY OF THE DRAWINGS

For a better understanding of the present invention, and to show how the same may be carried out in practice, reference will now be made to the accompanying drawings, in which.

DETAILED DESCRIPTION OF PREFERRED EMBODIMENT

Figure 1:
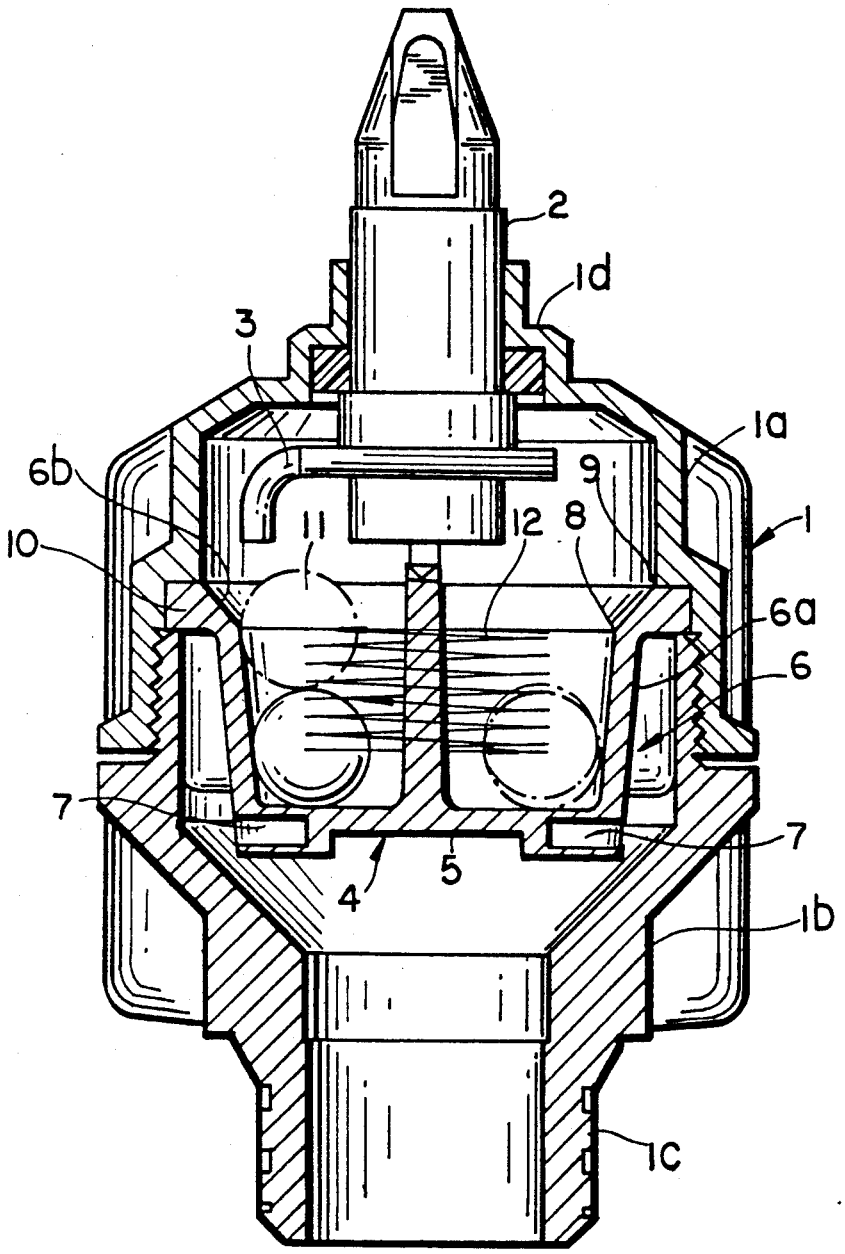
FIG. 1 is a longitudinally sectioned view of one form of rotary sprinkler in accordance with the present invention, illustrating the rotational and translational movement of a drive ball.
Figure 2:
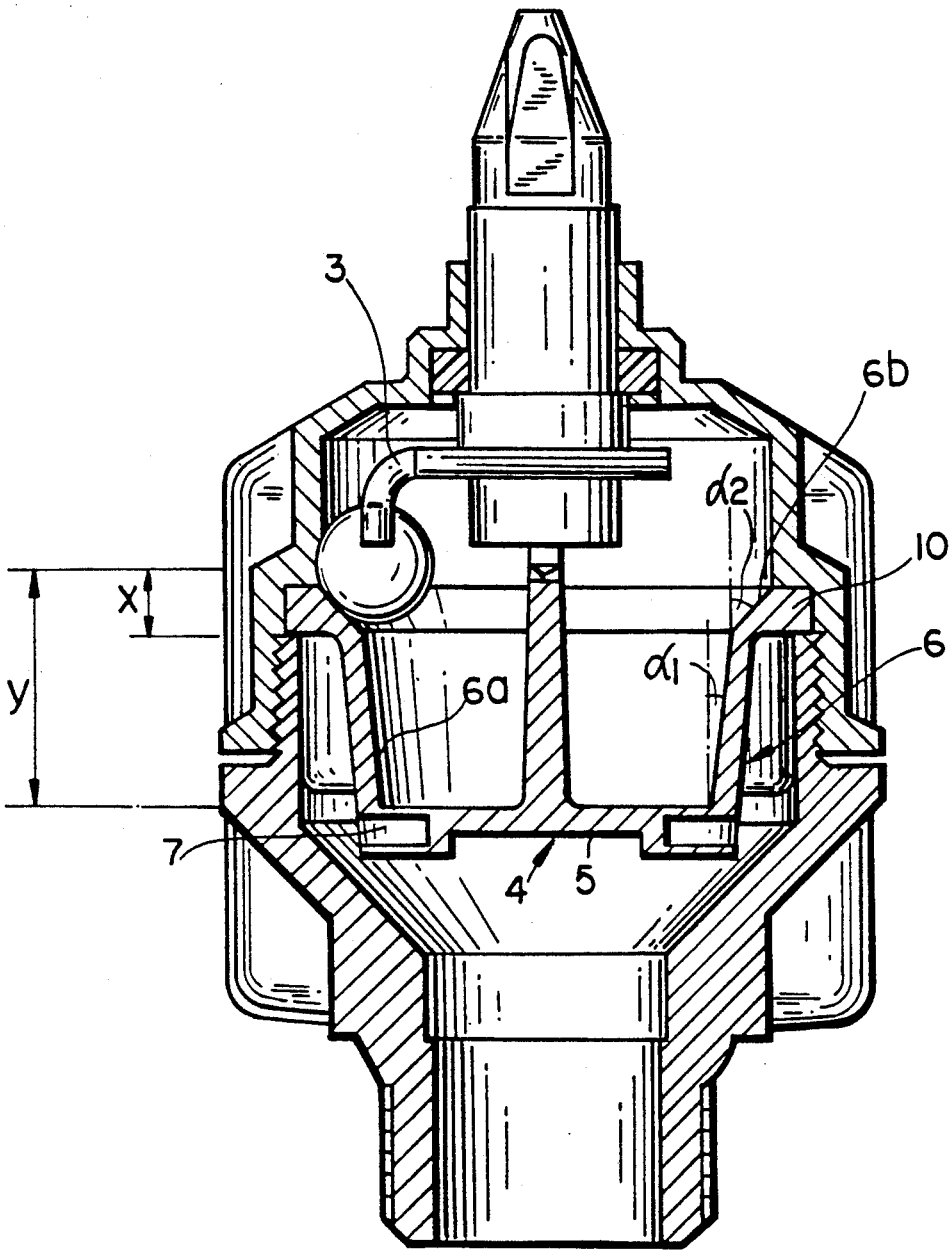
FIG. 2 is the same view of the rotary sprinkler with the drive ball shown when impacting an impeller element.

As seen in FIGS. 1 and 2 of the drawings, the rotary sprinkler comprises a sprinkler housing 1 consisting of an upper housing component 1*a* screw coupled to a lower housing component 1*b*. The lower component 1*b* is formed with a water inlet 1*c* of the housing 1. Rotatably located within a water outlet 1*d* of the housing component 1*a* is an elongated outlet nozzle 2 whose construction will be described in detail with reference to FIGS. 3 and 4 of the drawings. The lowermost portion of the outlet nozzle 2 located within the housing 1 is formed integrally with a downwardly directed impeller element 3.

A cup-shaped drive motor enclosure 4 is located within the housing 1 and comprises a substantially planar base wall 5 and an outwardly tapering side wall 6. The base wall 5 is formed with a pair of tangentially directed water inlet apertures 7. The outwardly tapering side wall 6 comprises a first major axial portion 6*a* extending from the base wall 5 to an intermediate peripheral portion 8 thereof so as to define an angle $\alpha_1$ with respect to a normal to the base wall 5 and a successive second minor axial portion 6*b* which extends from the intermediate peripheral position 8 to an edge rim 9 of the housing and so as to define a second angle $\alpha_2$ with respect to the normal to the base wall. As can be seen, $\alpha_2$ is substantially greater than $\alpha_1$. The housing is formed with an outwardly directed peripheral flange 10 which extends outwardly from the rim 9, the flange 10 being sandwiched between the screw-coupled-together housing portions 6*a* and 6*b*, thereby securely mounting in position the enclosure 6 within the housing 1.

As can be seen, the lowermost tip of the impeller element 3 is spaced from the peripheral position 8 by a distance x and from the base wall 5 by a distance Y.

A steel drive ball 11 is located within the housing 6 and is of a diameter D such that the distance Y is not substantially less than 2 D, whilst the distance X is not substantially less than 0.5 D.

If now water flows into the sprinkler housing 1 via the housing inlet 1*c* and into the enclosure 6 via the tangentially disposed water inlets 7, the drive ball 11 will have imparted to it a rotational motion and, at the same time, an upwardly directed displacement and will therefore effectively undergo an upwardly directed helical displacement as shown by the arrow 12 in FIG. 1. This displacement continues until the ball 11 reaches the intermediate peripheral position 8 (where it is still significantly displaced from the lower tip of the impeller element 3) and, at this stage, the continued displacement of the drive ball 11 results in a very rapid movement of the ball over the minor axial portion 6*b* until it is disposed well above the lower tip of the impeller element 3, which it then impacts at a relatively substantial peripheral position thereof. This impact of the ball and the impeller element results in the transfer to the impeller element of the ball's momentum, causing the instantaneous rotational displacement of the impeller element and its associated nozzle 2. The ball thereupon falls downwardly under gravity towards the base wall 5 of the enclosure 6 and, thereafter, starts again on its rotational and translational movement upwardly towards the impeller element 3.

Thus, with the rotary sprinkler and particularly with the drive motor thereof as described and illustrated, the rotary displacement of the drive nozzle is intermittent with relatively significant intervals between each displacement, the magnitude of each interval being determined by the time it takes for the drive ball to be rotatably displaced from its initial position in contact with the base wall 5 of the enclosure 4 into its impacting position with the impeller element 3.

In one embodiment of the present invention,

D=8 mm.

X=6 mm.

Y=20 mm.

$4° \leqq \alpha_1 \leqq 7°$ (preferably $\alpha_1 = 5°$)

$40° \leqq \alpha_2 \leqq 60°$ (preferably $\alpha_2 = 45°$)

Furthermore, the lateral spacing between the tip of the impeller element and the centre of the base wall was not substantially less than 1.75 D (i.e. 14 mm.).

With such a rotary sprinkler, it is found that the range of sprinkling is considerably extended, as compared with a rotary sprinkler wherein the drive ball effectively rotates the nozzle substantially continuously.

Whilst the embodiment just described has involved the use of an enclosure with a smooth outwardly tapering side wall 6, the invention is equally applicable to a situation where this outwardly tapering side wall is helically grooved, thereby providing a helically grooved wall race.

It is to be pointed out that, by virtue of the use of the present invention wherein the side wall 6, which defines a relatively small first angle $\alpha_1$ with the normal to the base wall 5, terminates in a second minor axial portion 6*b* which defines a much larger angle angle $\alpha_2$ with respect to this normal, it is possible to achieve an enclosure structure which is very much more axially compact as compared with the prior art structures wherein the outwardly tapering side wall extends towards the region of the impeller element at a relatively uniform angle.

Figure 4:
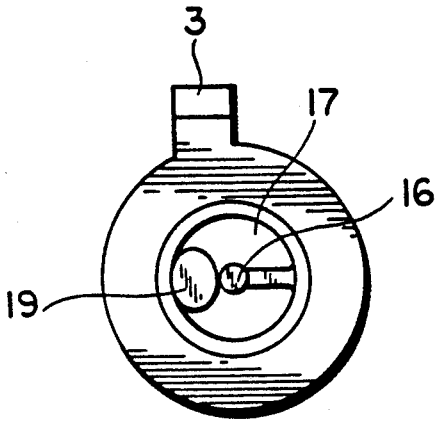
FIG. 4 is a plan view from below of the rotary nozzle shown in FIG. 3.
Figure 3:
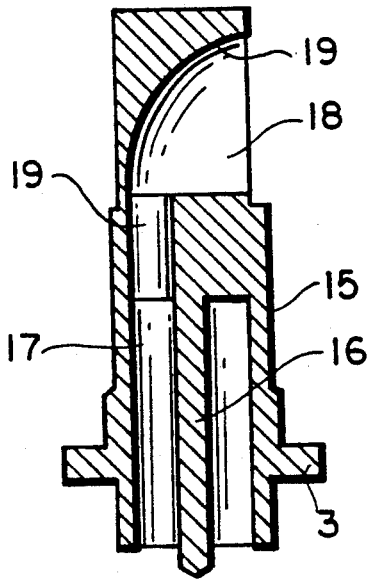
FIG. 3 is a longitudinally sectioned view of a rotary nozzle of the rotary sprinkler shown in FIGS. 1 and 2.

Reference will now be made to FIGS. 3 and 4 of the drawings for a description of the outlet nozzle 2 shown in FIG. 1. As seen in the drawings, the outlet nozzle 2 comprises a tubular element 15 having a central, downwardly extending centering the lowermost tip thereof is adapted to fit into a corresponding recess formed in a centrally directed supporting pin 17 which extends upwardly and integrally from the base wall 5 of the enclosure 4. Formed within the tubular element 15 is an axially directed tubular throughflow passage 17 and an outlet chamber 18 having an upper curved deflecting wall 19. The throughflow passage 17 communicates with the outlet chamber 18 via a substantially elliptically-shaped outlet 19.

It has been found that, by virtue of the provision of the elliptically-shaped outlet 19, a more effective outlet spray of significant range can be achieved.

It will be appreciated that whilst the outlet nozzle 2 described above has been shown as forming part of a specific form of rotary sprinkler in accordance with the present invention, the construction of this outlet nozzle with its elliptically-shaped outlet is capable of being used with other forms of rotary sprinklers.

I claim:

1. A rotary sprinkler comprising a sprinkler housing; a water inlet of said housing; an outlet nozzle of said housing rotatably mounted with respect thereto; an open ended drive motor enclosure fixedly located within said housing; a base wall of said enclosure; an axially directed side wall of said enclosure which tapers outwardly with respect to said base wall; at least one tangentially directed opening formed in said base wall and communicating with said water inlet; a drive ball of predetermined diameter (D) located in said enclosure; an impact element formed integrally with said nozzle and spaced from said base wall by a distance which is not substantially less than 2 D;

characterised in that a first major axial portion of said side wall extending from said base wall to an intermediate peripheral position thereof defines a first angle $\alpha_1$ with respect to a normal to the said base wall whilst a second minor axial portion of said side wall, extending from said intermediate peripheral position to an edge rim of the enclosure, defines a second angle $\alpha_2$ with respect to a normal to the base wall wherein $\alpha_2$ is substantially greater than $\alpha_1$, said impact element being spaced from said intermediate peripheral position by a distance which is not substantially less than 0.5 D.

2. A rotary sprinkler according to claim 1, characterised in that $1° \leqq \alpha_1 15°$ whilst $45° \leqq \alpha_2 \leqq 60°$.

3. A rotary sprinkler according to claim 2, characterised in that $4° \leqq \alpha_1 \leqq 5°$ whilst $40° \leqq \alpha_2 \leqq 50°$.

* * * * *